US007295174B2

(12) United States Patent
Watanabe et al.

(10) Patent No.: US 7,295,174 B2
(45) Date of Patent: Nov. 13, 2007

(54) DISPLAY UNIT

(75) Inventors: Toshimitsu Watanabe, Yokohama (JP); Nobuaki Kabuto, Kunitachi (JP); Mutsumi Suzuki, Kodaira (JP); Yoshihisa Ooishi, Yokohama (JP); Mitsuo Nakajima, Yokohama (JP); Junichi Ikoma, Yokosuka (JP)

(73) Assignee: Hitachi, Ltd., Tokyo (JP)

( * ) Notice: Subject to any disclaimer, the term of this patent is extended or adjusted under 35 U.S.C. 154(b) by 447 days.

(21) Appl. No.: 10/693,788

(22) Filed: Oct. 24, 2003

(65) Prior Publication Data

US 2005/0001792 A1 Jan. 6, 2005

(30) Foreign Application Priority Data

Jun. 18, 2003 (JP) ..... 2003-172772

(51) Int. Cl.
*G09G 3/20* (2006.01)
*G09G 3/22* (2006.01)

(52) U.S. Cl. ..... 345/75.2; 345/537

(58) Field of Classification Search ..... 345/75.1–75.2, 345/98, 536–537

See application file for complete search history.

(56) References Cited

U.S. PATENT DOCUMENTS 5,734,361 A * 3/1998 Suzuki et al. ..... 345/75.2
2002/0089473 A1* 7/2002 Yamazaki et al. ..... 345/75.2
2003/0025717 A1* 2/2003 Nakano ..... 345/690
2003/0107542 A1 6/2003 Aba et al.
2003/0201954 A1* 10/2003 Hansen et al. ..... 345/75.2
2003/0210211 A1* 11/2003 Moon ..... 345/75.2

FOREIGN PATENT DOCUMENTS

JP 07264591 A * 10/1995
JP 08-248921 9/1996
JP 11-149273 6/1999
JP 2000-242208 9/2000
JP 2002-229506 A 8/2002
JP 2002-366080 A 12/2002
JP 2003-022044 1/2003
JP 2003-157040 A 5/2003

* cited by examiner

*Primary Examiner*—Amr A. Awad
*Assistant Examiner*—Michael Pervan
(74) *Attorney, Agent, or Firm*—Townsend and Townsend and Crew LLP

(57) ABSTRACT

The present invention reduces smears arising from voltage decreases caused by the wiring resistance of scan lines for electron emission device selection. The display unit includes an FED panel in which scan lines, data lines, and electron supply devices are positioned at the intersections of the data lines and scan-lines. A scan driver for supplying a selection signal to the scan lines, and a data driver for supplying a drive signal to the data lines are provided. Electron emission devices selected by the selection signal are driven by the drive signal. A signal corrector circuit individually corrects the drive signal to be supplied to each data line to compensate for a voltage decrease caused by the wiring resistance in each column of the scan lines.

12 Claims, 5 Drawing Sheets

Correction value $\begin{cases} Ci = C_{i-1} + \sum_{j=1}^{8} k \cdot Dj \\ \text{where } i \geqq 0, C_{-1} = 0, \text{ and } k \text{ is a coefficient} \end{cases}$

DISPLAY UNIT

BACKGROUND OF THE INVENTION

The present invention relates to a field emission display (hereinafter referred to as an FED) and other matrix display units in which pixels are arranged in a matrix format.

The structure of the FED is illustrated in FIG. 1 and paragraphs No. 0071 to 0079 of JP-A No. 248921/1996. More specifically, a plurality of electron emission devices are arranged in a matrix format at the intersection of a plurality of line electrodes (scan lines) extending in the row direction (in the horizontal direction of the display screen) and a plurality of column electrodes (data lines) extending in the column direction (in the vertical direction of the display screen), and a scan signal is applied to the above scan lines to select a line of electron emission devices. A drive signal based on a video signal is then supplied to the selected line of electron emission devices to emit electrons. The emitted electrons then collide with phosphors, which are positioned opposite the electron emission devices to emit light and form an image. When the employed FED is structured as described above, the voltage decreases or increases to incur brightness irregularities due to scan line or data line wiring resistance. This problem is disclosed, for instance, in JP-A No. 248921/1996, JP-A No. 149273/1999, and JP-A No. 22044/2003.

BRIEF SUMMARY OF THE INVENTION

There are various types of electron emission devices, including a carbon nanotube (CNT) type, a surface conduction emitting device (SED) type, a metal-insulator-metal (MIM) type, and a ballistic electron-emitting device (BSD) type. The SED type and MIM type emit electrons when an electrical current flows internally in accordance with the potential difference from an applied selection signal or drive signal. The amount of electron emission increases with an increase in the current flow within an electron emission device (hereinafter referred to as the internal current). For the SED, BSD and MIM type, the emitter efficiency, which represents the ratio between the amount of electron emission and the internal current, is approximately 1%-5%. Therefore, the SED, BSD and MIM type are considerably affected by a voltage decrease that occurs when the above internal current flows to a wiring resistor in the connected scan line. The greater the internal current, that is, the drive signal, the more significant the voltage decrease. Therefore, if, for instance, a video signal on which the drive signal is based displays a highly bright (white) image within a certain area, image smears (ghost-like color/brightness irregularities) appear on the normal boundaries of the area because of the influence of the voltage decrease.

For the purpose of reducing brightness irregularities arising from a voltage decrease caused by scan line or data line wiring resistance, the inventions disclosed by Documents 1 and 2 apply predetermined correction data to the drive signal in consideration of a voltage decrease. As described earlier, the voltage decrease varies with the drive voltage supplied to each electron emission device, that is, the video signal. However, voltage decrease changes with the magnitude of video signal are not considered by the inventions disclosed by Documents 1 and 2. Although the invention disclosed by Document 3 varies the value of correction data in accordance with the video signal, it calculates the correction data for each of a plurality of nodes into which the display screen is horizontally divided but does not obtain the correction data for each of the drive signals supplied to the individual data lines.

In consideration of the problems described above, this invention provides a display unit capable of preferably reducing image brightness irregularities caused by the voltage decrease yet displaying a high-quality image. The display unit according to the present invention corrects drive signals, which are supplied respectively to a plurality of electron emission devices connected to scan lines, in accordance with video signals on which the drive signals are based. This correction is made by a signal corrector circuit in a manner that compensates for a voltage decrease occurring when the aforementioned internal current flows to scan lines that are connected to selected lines of a plurality of electron emission devices.

When the wiring resistance per scan line pixel (for each intersection with a data line) is r and the individual pixel (electron emission device) internal current flow from a data line to a scan line is Ii, the resulting voltage decrease per pixel is r×Ii. The present invention is configured to correct the amplitude of each drive signal by using this voltage decrease value as a correction value to correct the video signal corresponding to each pixel beforehand.

Since the above configuration corrects each of the drive signals supplied to various electron emission devices arranged horizontally in rows, the video-signal-dependent voltage decrease in each pixel can be compensated for on an individual basis. Therefore, the present invention compensates for brightness irregularities with high accuracy to reduce smears.

DETAILED DESCRIPTION OF THE INVENTION

Figure 1:
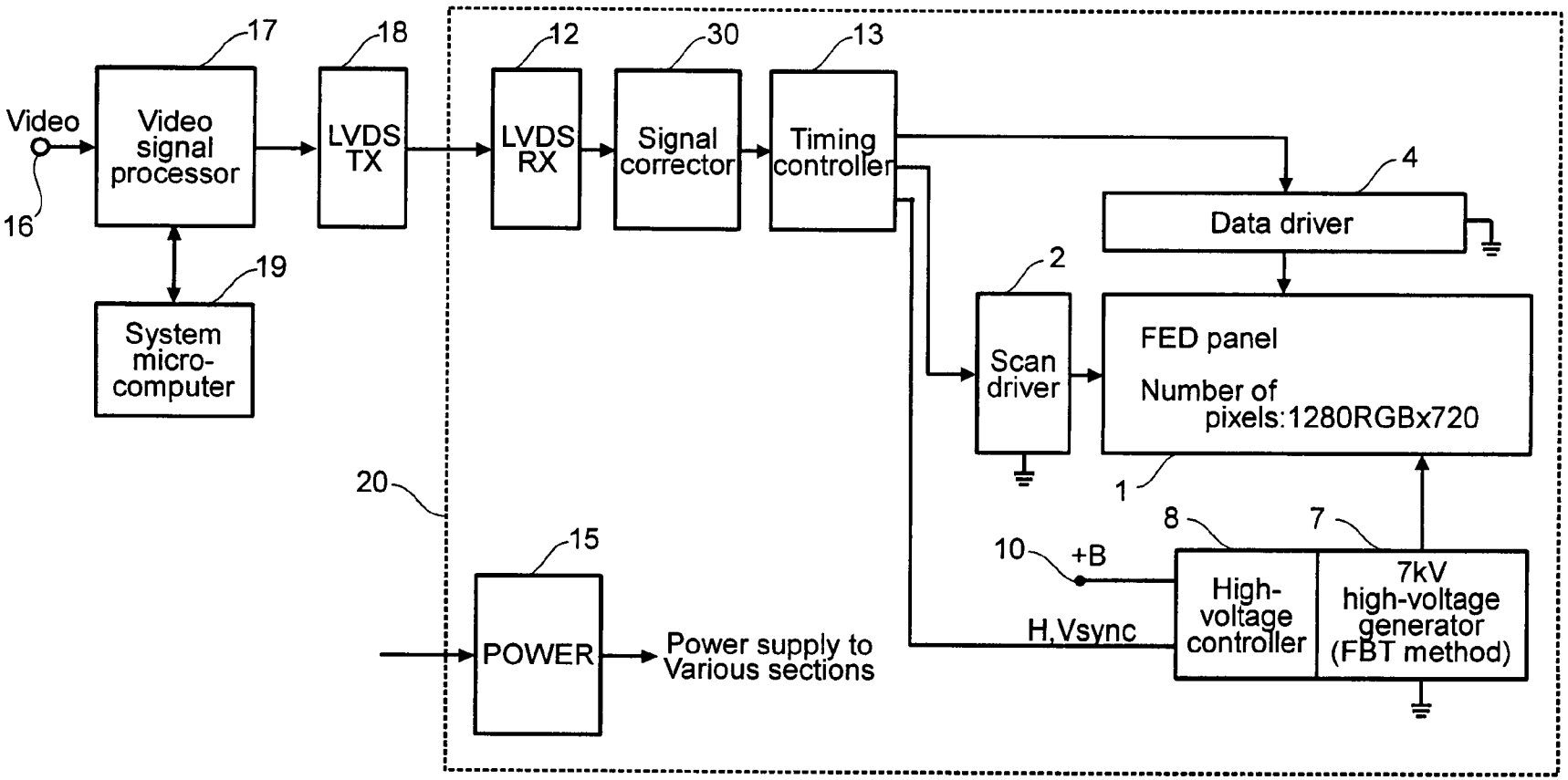
FIG. 1 is a block diagram illustrating a first embodiment of a display unit according to the present invention.

Embodiments of the present invention are now described with reference to the accompanying drawings. FIG. 1 is a diagram illustrating a first embodiment of a display unit (FED) according to the present invention. The first embodiment is characterized in that it comprises a signal corrector circuit 30, which is capable of providing brightness corrections on an individual pixel basis.

After being entered from a video signal terminal 16, a video signal goes into a video signal processor circuit 17 and is subjected to various signal processes such as amplitude, black level, and hue adjustments. A system microcomputer 19 stores, for instance, setup data necessary for amplitude, black level, and hue adjustments in video signal processor circuit 17, and controls the signal process performed in video signal processor circuit 17 in accordance with the setup data. The video signal processed by video signal processor circuit 17 is supplied to an LVDSTx circuit (low-voltage differential signaling transmitter) 18, which is a transmitter for an interface section, and is transmitted to an FED module 20 as a digital video signal.

FED module 20 includes an LVDSRx circuit (LVDS receiver) 12, a signal corrector circuit 30, a timing controller 13, a scan driver 2, a data driver 4, FED panel 1, a high-voltage generator circuit 7, a high-voltage controller circuit 8, a power supply circuit 15, etc. The digital video signal transmitted from the LVDSTx circuit 18 is received by LVDSRx circuit (LVDS receiver) 12, which is a receiver for the interface section provided for FED module 20. The digital video signal received by the LVDSRx circuit is corrected by signal corrector circuit 30 to compensate for the aforementioned voltage decrease. The details of such correction will be described later. The video signal corrected by signal corrector circuit 30 enters timing controller 13. To ensure that scan driver 2, data driver 4, and high-voltage controller circuit 8 operate with optimum timing, timing controller 13 transmits a timing signal and video data that are based on horizontal and vertical synchronization signals, which are entered together with the above video signal.

The FED panel 1 is a passive-matrix video display unit. It has a rear substrate and front substrate that face each other. On the rear substrate, a plurality of data lines extending vertically, in the column direction of the display screen, are arranged horizontally, in the row direction of the display screen, and a plurality of scan lines extending in the row direction are arranged in the column direction. An electron emission device is positioned at all the intersections of a plurality of data lines arid a plurality of scan lines in order to arrange a plurality of electron emission devices in a matrix format. On the front circuit, a phosphor is positioned opposite each electron emission device.

Scan driver 2 is connected to the scan lines of FED panel 1. In accordance with a timing signal from timing controller 13, scan driver 2 performs a line selection operation by applying a selection signal, which is used for selecting one or two lines of a plurality of electron emission devices, to the scan lines sequentially in the column direction. The selection signal is set, for instance, at a voltage of 0 V for selection and at a voltage of 5 V for deselection. Further, data driver 4 is connected to the data lines of FED panel 1. In accordance with a video signal from timing controller 13, data driver 4 supplies a drive signal based on an input video signal to the data lines for each line of electron emission devices. Data driver 4 also complies with the timing signal from timing controller 13 to retain one-line data of FED panel 1, that is, one line of video data fed from the timing controller, for one horizontal period, and update the data at intervals of one horizontal period. FIG. 1 assumes that FED panel has 1280×3 horizontal pixels and 720 vertical pixels. In this configuration, the data driver requires twenty 192-output LSIs and the scan driver requires six 128-output LSIs. In FIG. 1, these LSIs are represented respectively by blocks 2 and 4.

FED panel 1 has an anode terminal to which a high-voltage generator circuit 7 for applying a high voltage (e.g., 7 kV) to the anode terminal is connected. The high voltage is generated according to a supply voltage that is supplied to a power supply terminal 10, and controlled by high-voltage controller circuit 8. The supply voltage is generated, for instance, by increasing the voltage of power supplied to a connector 15 that is provided for FED module 20.

The display operation of the FED that is configured as described above is now described. When data driver 4 sends a drive signal through the data lines to one selected line of electron emission devices to which a selection signal is applied by scan driver 2 through the scan lines, the electron emission devices in the selected line emit electrons the amount of which varies with the potential difference between the selection signal and drive signal. Since the level of the selection signal applied at the time of selection remains unchanged without regard to the electron emission device positions, the amount of electron emission from the electron emission devices varies with the drive signal level (that is, depends on the level of a video signal on which the drive signal is based). Further, an acceleration voltage (e.g., 7 kV) is applied from high-voltage generator circuit 7 to the anode terminal of FED panel 1. Therefore, the electrons emitted from the electron emission devices are accelerated by the acceleration voltage to collide with the phosphors, which are mounted on the front substrate of FED panel 1. When the accelerated electrons collide with the phosphors, the phosphors become excited and emit light. The image of the selected horizontal line then appears on the display. Further, scan driver 2 applies a selection signal sequentially to a plurality of scan lines in the column direction in order to select one line of electron emission devices after another. In this manner, one image frame can be formed on the display surface of the FED panel. If the image displayed on FED panel 1 is bright, the amount of load current from high-voltage generator circuit 7 is large. If, on the other hand, the displayed image is dark, the amount of load current is small. The value of the voltage generated by high-voltage generator circuit 7 decreases with an increase in the amount of load current. However, high-voltage controller circuit 8 exercises high-voltage stabilization control to maintain the high-voltage value constant.

Figure 2:
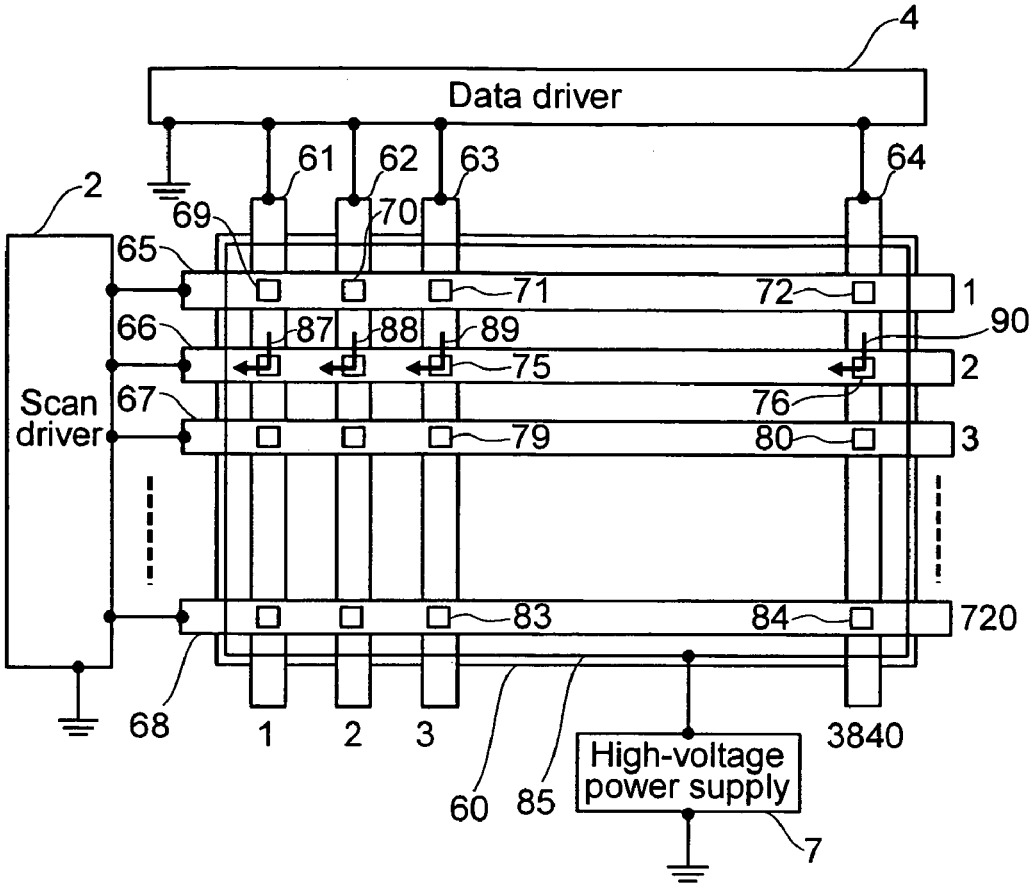
FIG. 2 shows an example of a wiring pattern for a display panel shown in FIG. 1.
Figure 3:
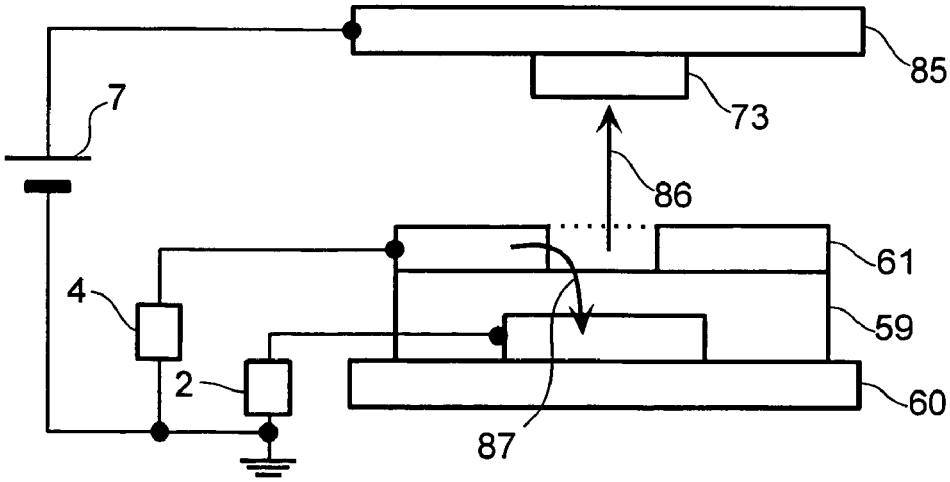
FIG. 3 illustrates the operation of an MIM electron emission device.
Figure 4:
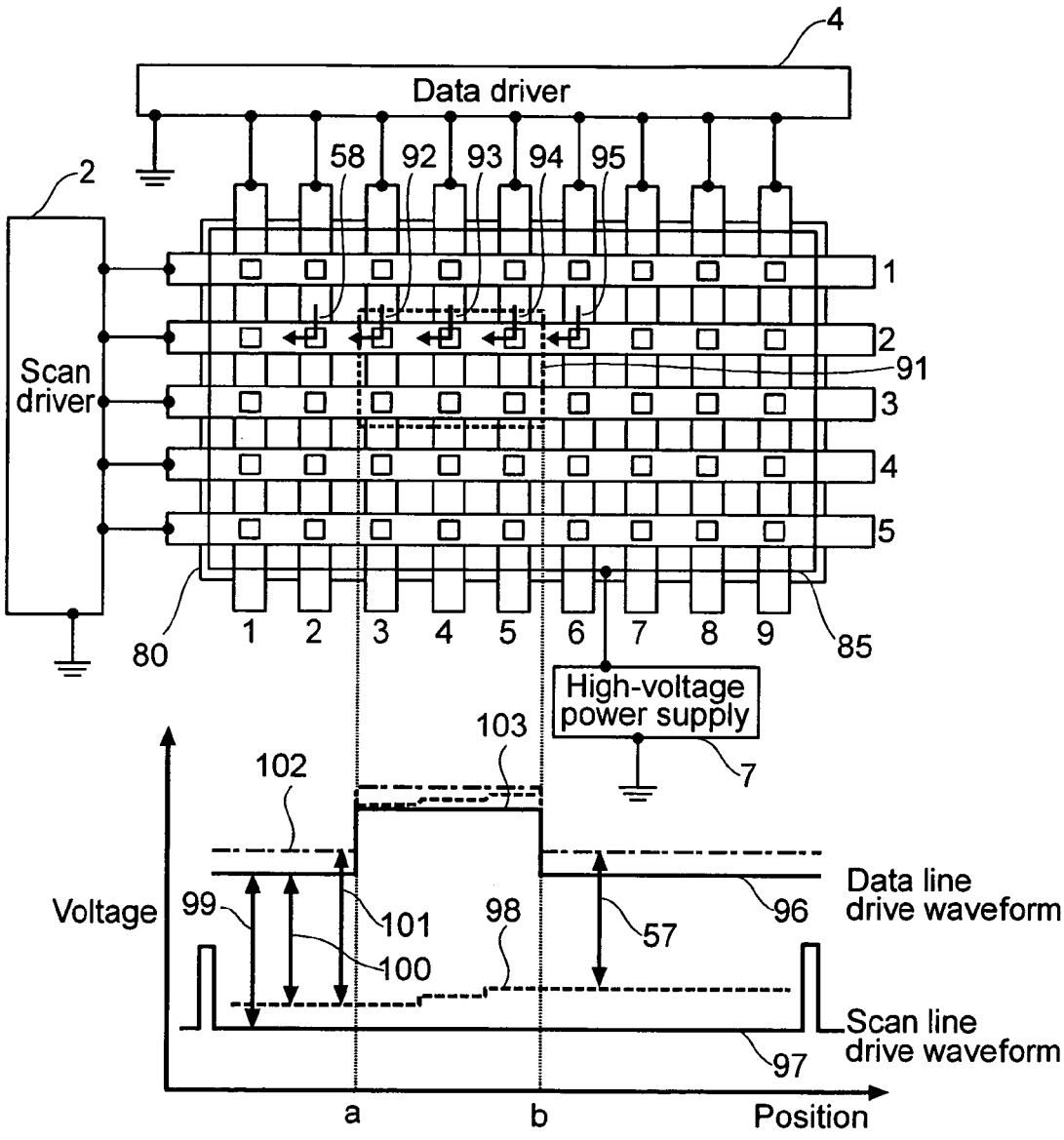
FIG. 4 illustrates the operation of the first embodiment shown in FIG. 1.
Figure 5:
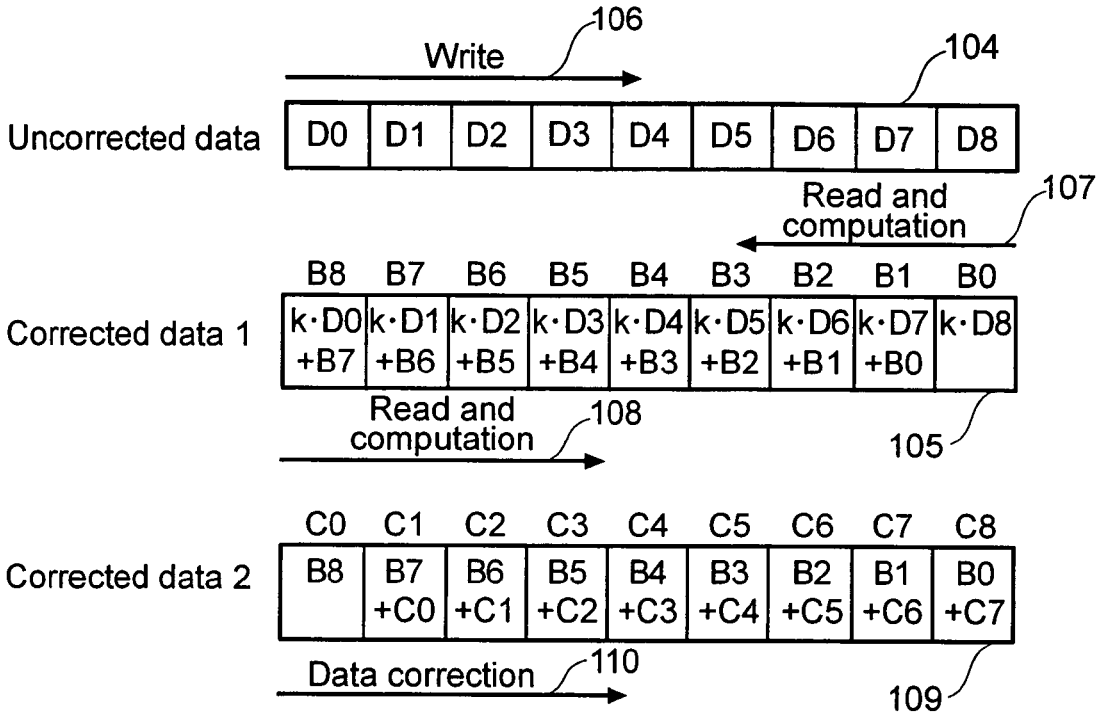
FIG. 5 illustrates how a signal corrector circuit of the first embodiment shown in FIG. 1 creates correction data.

The operation of signal corrector circuit 30 is now described with reference to FIGS. 2 to 5. FIG. 2 shows an example of an internal wiring structure of FED panel 1. FIG. 3 shows a schematic cross-sectional view of a pixel of the FED panel that is shown in FIG. 2. FIG. 4 illustrates the details of a correction operation by using a 5×9 matrix display as an example. FIG. 5 illustrates the details of a signal correction method according to the present invention. In FIG. 2, the reference numerals 65 to 68 denote scan lines (row selection lines); 61 to 64, data lines (column selection lines); 69 to 84, phosphors; 87 to 90, individual pixel current flows from scan lines to data lines; 60, lower glass substrate (rear substrate); and 85, upper glass substrate (front substrate). The numbers written at the end of data lines and scan lines represent a row or column number. For displaying a video signal in the second line, for instance, data driver 4 applies a selection signal to scan line 66 for selection purposes and supplies a predetermined analog voltage, which is a drive signal, to data lines 61 to 64.

FIG. 3 illustrates the operation of a pixel in the second line (pixel connected to the intersection of the second scan line and data line), which is performed with above selection made. This figure assumes that an MIM electron emission device (hereinafter simply referred to as an MIM) is used as an electron emission device. When a voltage of several to ten volts is applied between scan line 66 and data line 61 as a potential difference between the selection signal and drive signal, an electrical current 87 (hereinafter referred to as an MIM current) flows in the direction indicated by an arrow and passes through an insulation 59. When MIM current 87 flows, electrons are generated on the surface of the insulation 59. At the same time, the acceleration voltage from high-voltage generator circuit 7 generates an electric field in FED panel 1 to increase the speed of electron motion toward a phosphor 73 and form an electron beam 86. Electron beam 86 collides with phosphor 73 so that phosphor 73 becomes excited to emit light. The light emitted from the phosphor travels through upper glass substrate 85 and goes outside.

The intensity of light emission from phosphor 73 is substantially proportional to the current density of electron beam 86. The current density is proportional to MIM current 87. In other words, MIM current 87 is large when the intensity of light emission is high and small when the intensity of light emission is low. Therefore, the values of MIM currents 87-90 shown in FIG. 2 vary from one pixel to another depending on the contents of an image for one horizontal line. These currents 87-90 all flow through scan line 66 and reach scan driver 2. Since the scan line normally has a wiring resistance of several to ten-odd ohms, the voltage decreases depending on the current flowing through the scan line. If the intersection of a scan line and data line, that is, a pixel, is regarded as one unit, the scan line wiring resistance value prevalent at each pixel position increases with an increase in the distance from scan driver 2. If scan line 66 exhibits a considerable wiring resistance, brightness irregularities arise in the horizontal direction of the display screen because the magnitude of voltage decrease by the MIM current greatly varies with the pixel position and video signal. Therefore, if no correction is provided to compensate for the voltage decrease, it is difficult for the display unit to display a clear image without brightness irregularities. Signal corrector circuit 30 according to the present invention controls the drive signal from data driver 4 to compensate for voltage changes arising from the voltage decrease.

The correction operation performed by signal corrector circuit 30 is now described in detail with reference to FIGS. 4 and 5. FIG. 4 is basically the same as FIG. 2 except that the former shows five rows and nine columns. It is assumed that a highly bright white image [fragment] is displayed in an area enclosed by broken line 91. More specifically, the example shown in FIG. 4 indicates that a white window is displayed in the area enclosed by broken line 91 whereas the rest of the screen is entirely black. As is obvious from the second line, the MIM currents are large for pixels within the white window enclosed by broken line 91 (currents 92 to 94) and small for pixels within the black area outside the white window (currents 58 and 95). The lower half of FIG. 4 shows voltage waveforms that are applied to the scan lines and data lines in this instance. The waveforms shown are based on a selection signal from scan driver 2. Waveform 97 is a scan line drive waveform and waveform 96 is a data line drive waveform. Since MIM currents 92-96 decrease the voltage within the white window area, data line drive waveform 96 varies stepwise in the white window area as indicated by broken line 98. Therefore, the potential difference between the scan line and data line (between the selection signal and drive signal) is as indicated by arrow 100, although it should be as indicated by arrow 99. Consequently, the level of the drive signal corresponding to current 58 is low so that a dark image results. If the drive voltage average value for the data line is adjusted and set as indicated by a one-dot chain line 102, the potential difference is improved as indicated by arrow 101; however, a dark image results because the voltage decrease corresponding to current 95 is small as indicated by arrow 57. For accuracy correction purposes, the voltage decrease invoked by the currents flowing between the scan line selected by scan driver 2 and various data lines should be calculated for each data line to produce a correction result indicated by broken line 103 in FIG. 4.

FIG. 5 shows a concrete example of a correction data creation operation that is performed by signal corrector circuit 30 to correct the drive signal for each data line. The video signal data fed from LVDSRx circuit 12 is entered once into memory 104 within signal corrector circuit 30. Since the video signal data is dot-sequential data, video data D0-D8 in various columns are memorized in the direction of arrow 106 (sequentially). The data is read in the opposite direction (in the direction of arrow 107) and, at the same time, the data correction value (correction data 1) is calculated and sequentially stored in memory 105 within signal corrector circuit 30. When a predetermined coefficient is k, correction data 1 for video data D8 is k×D8 and memorized as B0. Correction data 1 for video data D7 is obtained by adding the value B0 to the value k×D7 and memorized as B1. Correction data 1 for video data D6 is obtained by adding the value B1 to the value k×D6 and memorized as B2. Calculations are sequentially performed for all video data up to D0 to memorize the values up to B8. Next, memory 105 is sequentially read (in the direction of arrow 108) to calculate correction data 2 and store them in memory 109 within signal corrector circuit 30. The data stored in this manner are designated C0 to C8. Data C0 is the value B8 and used as correction data 2. Data C1 is obtained by adding the value C0 to the value B7 and handled as correction data 2. Data C2 is obtained by adding the value C1 to the value B6. The remaining data up to C8 are then sequentially calculated and memorized. Correction data 2, which are stored in memory 109, are correction values for video data D0 to D8. Therefore, Di+Ci is used as a corrected video signal. The formula for calculating the correction value Ci is shown in FIG. 5. The coefficient k, which is mentioned above, is determined according, for instance, to the specific resistance of the scan line, the efficiency of MIM, and the total number of pixels of FED panel 1. Equation 1 below is the general formula for the correction data calculation that is performed by signal corrector circuit 30 according to the present invention.

$$C_i = C_{i-1} + \sum_{j=1}^{n} k \cdot D_j \qquad \text{Equation 1}$$

where $i,j \geqq 1$, $c_0=0$, k=coefficient, and n=data line count.

As described above, the present invention took notice of the fact that the magnitude of voltage decrease varies with the magnitude of drive signals supplied to the pixels (electron emission devices) and the wiring resistance at the horizontal position of each pixel, and obtained a correction data calculation formula, which is represented by Equation 1 above. More specifically, the inventors found that the voltage decrease for a certain pixel is substantially proportional to the total value of the currents flowing to the intersection of the scan line and data line corresponding to the pixel, that is, the cumulative value of various currents (video data) flowing to one or more pixels that are more distant from scan driver 2 than the above-mentioned pixel. In the present invention, the cumulative value is applied to the calculation of correction data to compensate for a voltage decrease in each pixel with a view toward individually correcting the drive signals to be supplied to the pixels. Therefore, when a white window is displayed within a totally black area, the present invention gives substantially fixed correction data to a drive signal for pixels (electron emission devices) corresponding to a black area (i.e., the correction data value remains constant irrespective of the electron emission device's position in the row direction), as shown in FIG. 4, because the black area's video signal level is 0 or close to it. For a drive signal for pixels corresponding to the white window area, the present invention gives correction data that increases gradually as the distance to data driver 2 increases or increases stepwise on an individual column basis while considering a great voltage decrease because the video signal level for such area is high.

After completion of video data correction, signal corrector circuit 30 reads video data in the direction of arrow 110, and outputs the corrected video data Di+Ci to timing controller 13. Timing controller 13 supplies the corrected video data Di+Ci to data driver 4 with predetermined timing. Data driver 4 distributes the corrected video data Di+Ci, as a drive signal, to various data lines (columns) associated with the number i. A desired drive signal waveform whose wiring-resistance-induced voltage decrease (or voltage increase) is compensated for can then be obtained for each data line. As described above, the first embodiment can equalize the voltage differential between the scan line and data line with the drive voltage for the video signal to be entered, and provide an FED whose brightness irregularities, namely, smears are reduced.

Figure 6:
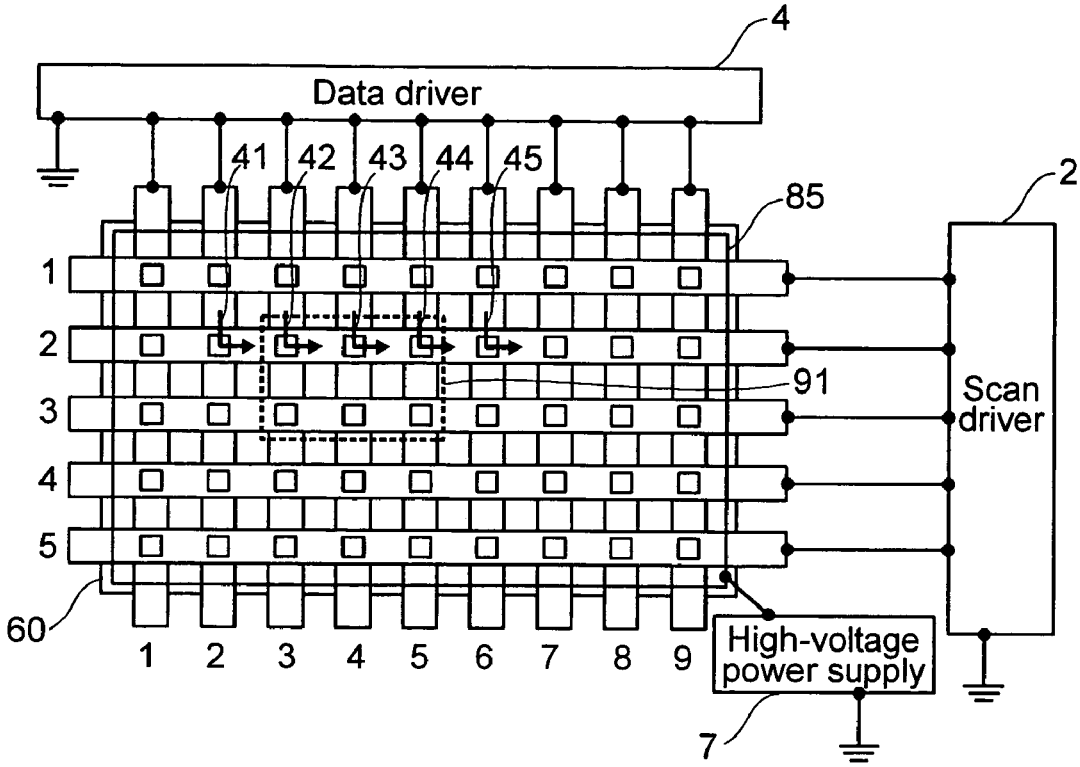
FIG. 6 is a block diagram illustrating a second embodiment of a display unit according to the present invention.

FIG. 6 illustrates a second embodiment of an FED according to the present invention. Components identical with the counterparts described with reference to FIG. 4 are assigned the same reference numerals as their counterparts and are not described again in detail. Portions differing from those shown in FIG. 4 are described with reference to FIG. 6. Scan driver 2 is positioned to the right of the scan lines so that the currents from the data lines flow rightward as represented by currents 41 to 45. In this instance, the voltage applied between electrodes for each pixel varies with the scan line wiring resistance. However, the drive signals for such pixels are corrected by sequentially adding up currents 41 through 45. Since current 41 flows toward scan driver 2, all the pixels intersecting data lines Nos. 3 to 9 are affected. Therefore, the components of current 41 are corrected in subsequent data lines Nos. 3 to 9; the components of current 42 are corrected in subsequent data lines Nos. 4 to 9; and the components of current 43 are corrected in data lines Nos. 5 to 9. In other words, when the video data corresponding to a specific current is Di and the predetermined coefficient is k, the purpose is achieved by means of cumulative adding according to Equation 2 shown below:

$$C_i = \sum_{j=1}^{i} k \cdot D_j \qquad \text{Equation 2}$$

where k is a coefficient.

Figure 7:
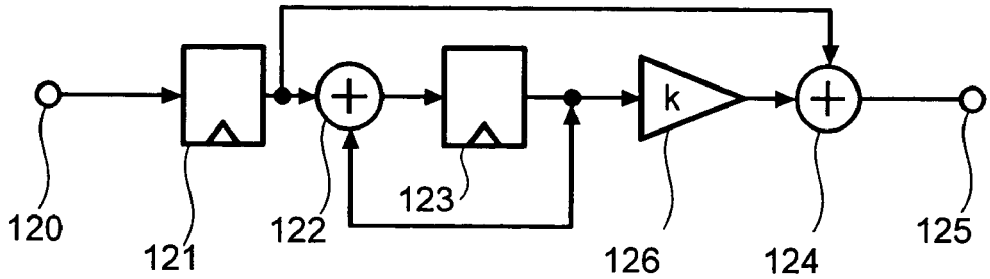
FIG. 7 illustrates details of a signal corrector circuit of the second embodiment shown in FIG. 6.

Since the signal entered into data driver 4 is originally a dot-sequentially scanned video signal, data is first given to data line No. 1 of data driver 4 and then to data line No. 2. Therefore, when the circuit shown in FIG. 7 is used as a corrector circuit, it is possible to compensate for a wiring-resistance-induced decrease (or increase) in the drive signal amplitude between a data line and scan line. This correction operation is performed by signal corrector circuit 30 as is the case with the first embodiment. FIG. 7 shows a concrete example of a signal corrector circuit configuration according to the second embodiment. This corrector circuit does not require the use of a memory and comprises a data input terminal 120, flip-flops 121, 123, adders 122, 124, a coefficient multiplier 126, and a data output terminal 125. The bit widths of the flip-flops and adders are determined while considering the number of horizontal pixels, video data bit width, and correction accuracy. The video signal entered from the data input terminal 120 is dot-sequential data and transmitted in synchronism with a clock signal. The entered video signal is latched by flip-flop 121 and, on the next clock cycle, added to the output of the coefficient multiplier 126 at the adder 124. Since the output of the coefficient multiplier is 0 at this moment, video data D0 is output without being corrected. On the next clock cycle, the output of flip-flop is D0, and the output terminal 125 outputs the data D1+k×D0. At the same time, the output of adder 122 is D1+D0. On the next clock cycle, the output of flip-flop 123 changes to D1+D0 so that the output D2+k×(D1+D0) is obtained at the output terminal 125. The obtained output is sequentially supplied to data driver 4 and corrected. Since this process corrects the drive signals for the adjacent pixels, the present embodiment can more or less reduce the generation of smears and other irregularities.

As described above, the present invention can compensate for a voltage decrease caused by the currents flowing to various pixels and the wiring resistance at the intersections of scan lines and data lines by individually correcting the drive currents to be supplied to the pixels (electron emission devices). Thus, the present invention reduces the generation of brightness irregularities within the entire display screen and displays high-quality images with smears minimized. Although the foregoing descriptions of the embodiments of the present invention assume the use of MIM electron emission devices, the present invention can provide the same advantages even when it is applied to SED, BSD, or other electron emission devices that cause a current flow into the electron emission devices to emit electrons. As a result, the present invention provides a video display unit that is capable of displaying high-quality images.

What is claimed is:

1. A display unit comprising:

a plurality of electron emission devices arranged in a matrix format;

a plurality of scan lines arranged in a row direction and connected to the plurality of electron emission devices;

a plurality of data lines arranged in a column direction and connected to the plurality of electron emission devices;

a scan driver for supplying a selection signal for selecting a line of electron emission devices to the scan lines sequentially in the column direction;

a data driver for supplying drive signals based on video data for driving the electron emission devices to each of the plurality of data lines; and a signal correction circuit for correcting each of the drive signals to be supplied to the plurality of data lines, wherein the signal correction circuit corrects the drive signals using a cumulative value of the video data corresponding to said drive signals, the signal correction circuit comprising:

a first memory to sequentially store the video data corresponding to each of the data lines in a first direction, a second memory to store first correction data which is obtained by, for each data line, multiplying each of the video data read out from the first memory by a predetermined coefficient and then sequentially accumulating the multiplied data in a second direction opposite to the first direction, and a third memory to store second correction data as the cumulative value for each of the data lines, the second correction data being obtained by, for each data line, sequentially accumulating the first correction data read out from the second memory in the first direction.

2. The display unit according to claim 1 wherein the signal correction circuit provides corrections which vary with the position of the plurality of electron emission devices in the row direction.

3. The display unit according to claim 1 wherein an electrical current flows to each electron emission device in accordance with the potential difference between a selection signal and drive signal supplied to a plurality of electron emission devices in the selected line, and the correction values are determined so as to compensate for a voltage decrease in the row direction of each of the plurality of electron emission devices that is determined by the value of the current and the wiring resistance of the scan lines at various positions of a plurality of electron emission devices arranged in the row direction.

4. A display unit comprising:

a display panel including scan lines, data lines, and a plurality of electron emission devices arranged in a matrix format, the display panel responsive to a scan line selection signal to select a scan line thereby selecting a line of electron emission devices, and further responsive to a plurality of drive signals to drive each electron emission device of the line of electron emission devices, the drive signals being based on corresponding video data; and a signal correction circuit, comprising:

a first memory to sequentially store the video data corresponding to each of the data lines in a first direction, a second memory to store first correction data which is obtained by, for each data line, multiplying each of the video data read out from the first memory by a predetermined coefficient and then sequentially accumulating the multiplied data in a second direction opposite to the first direction, and a third memory to store second correction data as a cumulative value for each of the data lines, the second correction data being obtained by, for each data line, sequentially accumulating the first correction data read out from the second memory in the first direction, wherein a current according to a potential difference between the selection signal and the drive signals flows to corresponding electron emission devices of the line of electron emission devices along the selected scan line so that the electron emission devices emit electrons in accordance with the electric currents; and wherein the signal correction circuit corrects each of the drive signals to be supplied to the corresponding electron emission devices in order to compensate for a voltage decrease that arises when the current flows along the selected scan line, the drive signals being corrected based on the cumulative values of the video data.

5. A display unit comprising:

a plurality of scan lines extending in a row direction;

a plurality of data lines extending in a column direction;

an electron emission device positioned at intersections of the plurality of scan lines and the plurality of data lines;

a scan driver for supplying a selection signal to sequentially select lines of electron emission devices;

a data driver for supplying drive signals based on video data to drive electron emission devices of a selected line of electron emission devices; and a signal correction circuit for individually correcting the drive signals to be supplied respectively to the plurality of electron emission devices, the signal correction circuit comprising:

a first memory to sequentially store the video data corresponding to each of the data lines in a first direction, a second memory to store first correction data which is obtained by, for each data line, multiplying each of the video data read out from the first memory by a predetermined coefficient and then sequentially accumulating the multiplied data in a second direction opposite to the first direction, and a third memory to store second correction data as a cumulative value for each of the data lines, the second correction data being obtained by, for each data line, sequentially accumulating the first correction data read out from the second memory in the first direction, wherein the signal correction circuit corrects each drive signal by adding a correction value to its corresponding video data, levels of the correction values used to drive the electron emission devices being based on the position of the electron emission device within the selected line of electron emission devices, the correction values being based on the cumulative values of the video data.

6. The display unit according to claim 5 wherein the scan driver is connected to one end of the scan lines so that the correction values increase with an increase in the distance between electron emission devices connected to the scan lines and the scan driver while the video signal remains constant.

7. The display unit according to claim 5 wherein the correction values are determined in accordance with the magnitude of voltage decrease at each position of a plurality of electron emission devices connected to the scan lines.

8. A display unit, comprising:

a display panel in which m×n electron emission devices are arranged in a matrix format and positioned at the intersections of m scan lines and n data lines, and phosphors are positioned opposite the electron emission devices;

a data driver for supplying drive signals to the n data lines, each drive signal based on corresponding video data;

a scan driver for sequentially supplying a selection signal to at least one of the m scan lines for selecting a line of electron emission devices; and a signal correction circuit for compensating for a voltage increase caused by a current, Ii (i=1 to n), which flows from said data lines to a selected scan line, wherein the signal correction control circuit corrects the drive signals based on cumulative values of the video data, the signal correction circuit comprising:

a first memory to sequentially store the video data corresponding to each of the data lines in a first direction, a second memory to store first correction data which is obtained by, for each data line, multiplying each of the video data read out from the first memory by a predetermined coefficient and then sequentially accumulating the multiplied data in a second direction opposite to the first direction, and a third memory to store second correction data as the cumulative value for each of the data lines, the second correction data being obtained by, for each data line, sequentially accumulating the first correction data read out from the second memory in the first direction.

9. The display unit according to claim 8 wherein the signal correction circuit corrects the video data to be supplied to the data driver, and uses the value Di+Ci as the video signal when the video signal correction amount Ci is determined from Equation 1 below where columns are sequentially designated 1, 2, 3, and so on to n beginning with the one closest to the scan driver, the video signal amplitude of the i-th column is Di, and a predetermined coefficient is k:

$$C_i = C_{i-1} + \sum_{j=i}^{n} k \cdot D_j$$

where $i,j \geqq 1, C_0=0$, k=coefficient, and n=data line count.

10. The display unit according to claim 8 wherein the signal correction circuit corrects the video data to be supplied to the data driver, the data driver has been positioned at the other side of an initial data line to supply the drive signal, and the signal correction circuit provides cumulative additive correction by multiplying the video signal amplitude Di of the i-th column by a predetermined coefficient.

11. A display unit, comprising:

a display panel having a plurality of scan lines extending in a row direction, a plurality of data lines extending in a column direction, and a plurality of electron emission devices disposed at intersections of the plurality of scan lines and the plurality of data lines;

a scan driver for sequentially supplying a selection signal to the plurality of scan lines in the column direction to sequentially select lines of electron emission devices;

a data driver for supplying drive signals for driving corresponding electron emission devices of a selected line of electron emission devices via the plurality of data lines;

a video signal processor for processing the video signal and outputting the processed video signal as video data;

an interface section for transmitting and receiving the video data from the video signal processor; and a signal correction circuit configured to produce corrected video data by adding correction values to the video data received from the interface section and supply the corrected video data to the data driver, the signal correction circuit comprising:

a first memory to sequentially store the video data corresponding to each of the data lines in a first direction, a second memory to store first correction data which is obtained by, for each data line, multiplying each of the video data read out from the first memory by a predetermined coefficient and then sequentially accumulating the multiplied data in a second direction opposite to the first direction, and a third memory to store second correction data as a cumulative value for each of the data lines, the second correction data being obtained by, for each data line, sequentially accumulating the first correction data read out from the second memory in the first direction, wherein the data driver generates the drive signals based on the corrected video data, wherein levels of the correction values for the electron emitting devices in a selected line of electron emitting devices are based on positions of the electron emission devices in the selected line, the correction values being based on the cumulative values of the video data corresponding to the selected line of electron emitting devices.

12. The display unit according to claim 11 wherein the display panel, the scan driver, and the data driver constitute a display module; wherein a receiver of the interface section is positioned toward the display module; and wherein a transmitter of the interface section transmits a video signal from the video processor circuit to the receiver in digital form.

* * * * *